United States Patent [19]

Fletcher et al.

[11] 4,077,344

[45] Mar. 7, 1978

[54] SYSTEM FOR BEADING AND FLANGING CAN BODIES

[75] Inventors: Wade D. Fletcher, Hartsville; Robert A. Norwood, Darlington, both of S.C.

[73] Assignee: Sonoco Products Company, Hartsville, S.C.

[21] Appl. No.: 727,339

[22] Filed: Sep. 28, 1976

[51] Int. Cl.[2] ..... B21D 43/00

[52] U.S. Cl. ..... 113/115; 113/1 G

[58] Field of Search ..... 113/16, 7 R, 7 A, 120 M, 113/120 R, 8, 115, 113 R; 72/471

[56] References Cited

U.S. PATENT DOCUMENTS

| | | | |
|---|---|---|---|
| 2,014,706 | 9/1935 | Sullivan | 113/1 G |
| 2,320,049 | 5/1943 | Pearson | 113/1 G |
| 3,418,837 | 12/1968 | Vanderlaan | 113/115 X |
| 3,483,722 | 12/1969 | Fink | 113/113 R X |
| 3,687,098 | 8/1972 | Maytag | 113/1 G |
| 3,797,429 | 3/1974 | Wolfe | 113/1 G |

*Primary Examiner*—Leon Gilden

*Attorney, Agent, or Firm*—Dennison, Dennison, Meserole & Pollack

[57] ABSTRACT

A system for the beading and flanging of opposed ends of a cylindrical can body wherein the opposed beading and flanging chucks are sequentially withdrawn. Stop means is mounted on the can carrying wheel adjacent the flanging chuck and cooperates with the flanging chuck for a retention of the flanged end of the can therein during the initial removal of the beading chuck which inherently effects a greater frictional engagement with the beaded end of the can. The stop allows a free subsequent withdrawal of the flanging chuck.

6 Claims, 9 Drawing Figures

SYSTEM FOR BEADING AND FLANGING CAN BODIES

The invention herein is generally concerned with the forming of can bodies for peel-top containers, and more particularly relates to a system for substantially simultaneously beading one end of a cylindrical can body and flanging the second end thereof.

Apparatus for the simultaneous or substantially simultaneous flanging or beading of opposed ends of cylindrical cans are evidenced by the following U.S. Pat Nos:

2,424,581 Peters
2,741,292 Butters
2,956,610 Diezel
3,062,263 Austing et al.
3,418,837 Vanderlaan et al.
3,483,722 Fink
3,688,538 Hoyne
3,782,314 Franek et al.
3,797,429 Wolfe Attention is also directed to several machines actually in use in the various involved industries, including one machine known commercially as Bliss Model 1315 and the Borden Horizontal Flanger Model 610. Each of these basically includes a pair of star wheels which sequentially carry a series of cylindrical can bodies along a path wherein they are engaged by opposed chucks or dies which simultaneously flange or otherwise form the opposed ends of the can and are subsequently withdrawn therefrom with the formed can discharging from the star wheel carriers. The selective engagement and disengagement of the chucks is effected through a series of camming guides including camming tracks and cam followers traveling in the tracks, this structure also being readily apparent in several of the above referred to patents, note for example Vanderlaan et al. 3,418,837.

In typical equipment of the type described supra, the forming being effected at the opposed ends of the container is the same, and as such, no difficulty has been encountered in effecting a simultaneous withdrawing of the opposed forming chucks. However, when different formations are to be provided on the opposed ends of a can body, a different frictional grip is developed at the opposed ends of the can due to the different deformations to which the can ends are subjected. This in turn precludes an effective stripping of the can from that chuck at which a greater frictional grip is developed during the can end formation. This problem is considered in great detail in Wolfe, U.S. Pat. No. 3,797,429, which is concerned with utilizing axially aligned necking and flanging dies, and wherein the problem is resolved by utilizing an elaborate air pressure controlled system for clamping the can body as required during a selective stripping of the dies.

It is the express purpose of the present invention to provide a system for enabling the substantially simultaneous beading and flanging of the opposed ends of a cylndrical can and the sequential withdrawal of the relatively tighter beading chuck and then the more easily withdrawn flanging chuck. This can be effected, in the preferred form of the invention, by a modification of an existing flanger, for example the Borden Horizontal Flanger Model 610 through merely a substitution of beading chucks for one series of flanging chucks, the provision of fixed can stops on the outer face of the star wheel adjacent the second set of flanging chucks for cooperation therewith in initially providing a means to prevent a sliding of the cans from the flanging chucks, and a slight change in the camming tracks to provide for an initial withdrawal of the beading chucks. The stops, while preventing withdrawal of the can bodies from the flanging chucks as the beading chucks are withdrawn, in no way interfere with the subsequent withdrawal of the flanging chucks.

While the apparatus of the invention can obviously be built as a new piece of equipment, the features of the invention particularly lend themselves to being adapted into commercially available equipment through a selective, relatively straight forward and economical modification thereof. This in turn will increase the versatility of existing equipment.

Additonal objects and advantages, considered to reside in the details of construction and operation, will become apparent as the invention is more fully hereinafter described and claimed. References had to the accompanying drawings forming a part hereof, wherein like numerals refer to like parts throughout, and in which:

Figure 7:
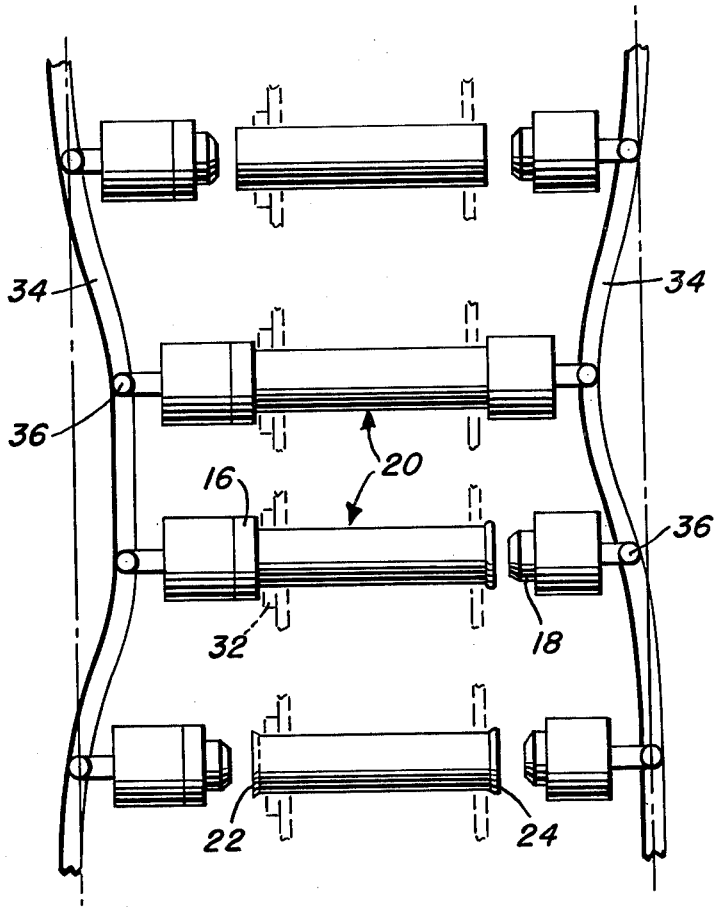
Figure 8:
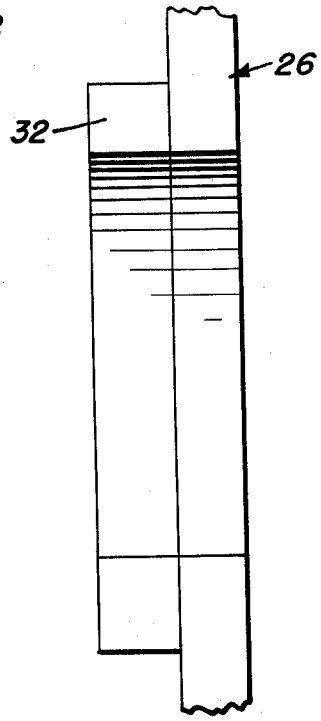
Figure 9:
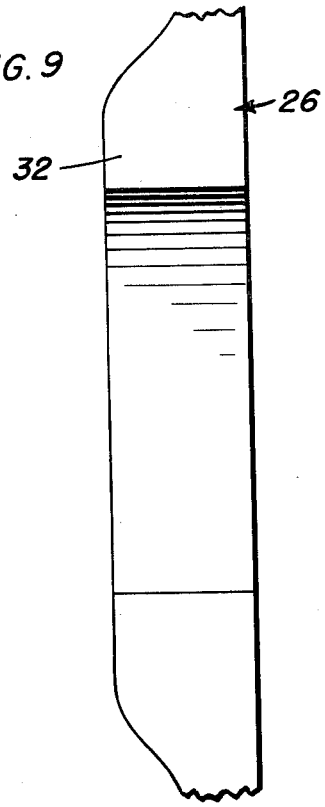

FIG. 7 schematically illustrates the camming system and the sequential steps in simultaneously engaging and sequentially disengaging the chucks;

FIG. 8 is an elevational detail of one of the pockets of the star wheel associated with the flanging chuck with the can stop affixed thereto; and FIG. 9 is a view similar to FIG. 8 illustrating the can stop formed as an integral portion of the star wheel.

Referring now more specifically to the drawings, reference numeral 10 is used to generally designate a machine incorporating the features of the present invention. This machine 10 incorporates a pair of spaced opposed simultaneously driven turrets 12 and 14 which respectively include sets of flanging chucks 16 and beading chucks 18. Each chuck of each turrent is axially aligned with a corresponding chuck on the other turrent for operation in conjunction therewith as shall be explained subsequently.

As indicated, the system herein is specifically intended for the forming of the opposed ends of cylindrical cans 20, providing a flange 22, through operation of a flanging chuck 16, on one end thereof, and a bead 24, by means of beading chuck 18, on the second end thereof.

The cans 20 are carried through the machine by a pair of laterally spaced star wheels 26 and 28 respectively spaced inward of the flanging chucks 16 and beading chucks 18. The star wheel 26 and 28 each include a set of can receiving pockets 30 respectively aligned with the adjoining chucks whereby each can, during its travel through the machine, will be supported within a pair of aligned pockets 30 with the opposed ends thereof respectively aligned with a pair of chucks 16 and 18 during the operational phases of these chucks. It will of course be appreciated that the chucks and star wheels rotate in synchronization about a common central axis. While not illustrated, any appropriate means can be provided for a feeding of the can body blanks to the star wheel carrier and, subsequent to a forming of the end thereof, receiving the formed bodies from the star wheel carrier.

The formation of the bead end 24 on a container body 20 causes such a deformation of the can end as to result in the development of a substantially greater coefficient of friction between the deformed end and the beading chuck 18 than is developed between the flanged end 22 and the flanging chuck 16. Thus, any attempt to either simultaneously or even sequentially withdraw the opposed chucks 16 and 18 will result in a lateral displacement of the can 20 on the star wheel carrier with the can 20 easily disengaging from the flanging chuck 16 and following the withdrawing beading chuck 18. Thus, the mere substitution of a set of beading chucks for one of the sets of flanging chucks in a conventional dual flanging machine would not enable an acceptable combined flanging and beading system.

Figure 1:
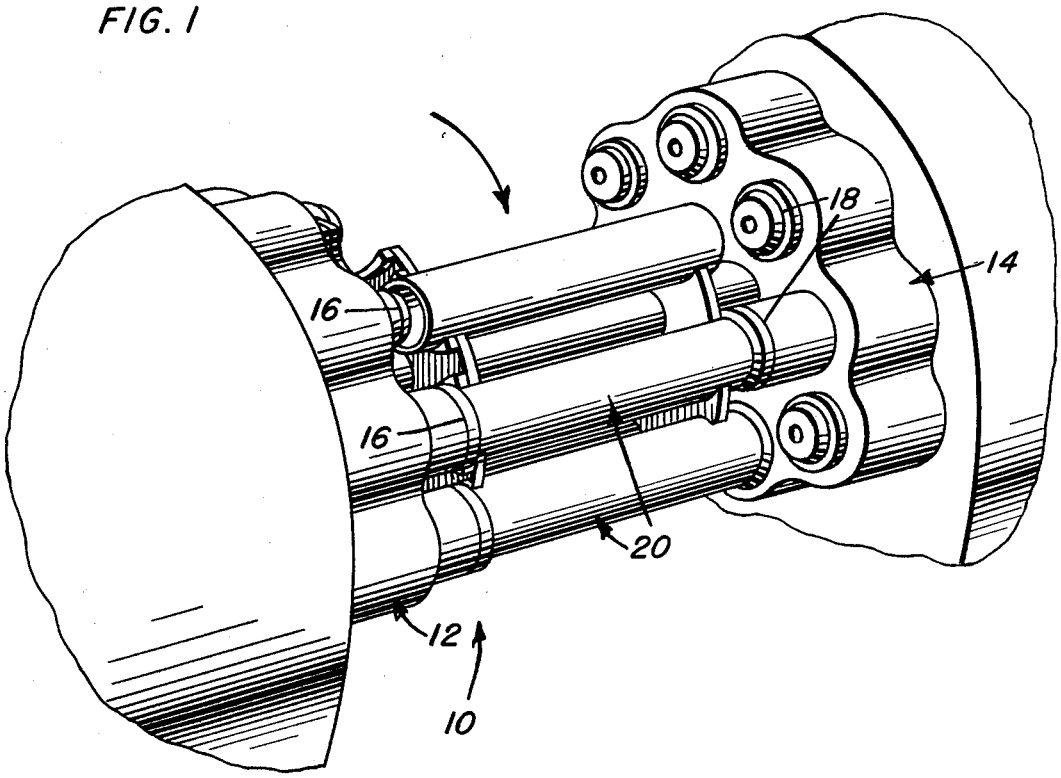
FIG. 1 is a perspective detail of apparatus incorporating features of the present invention.
Figure 2:
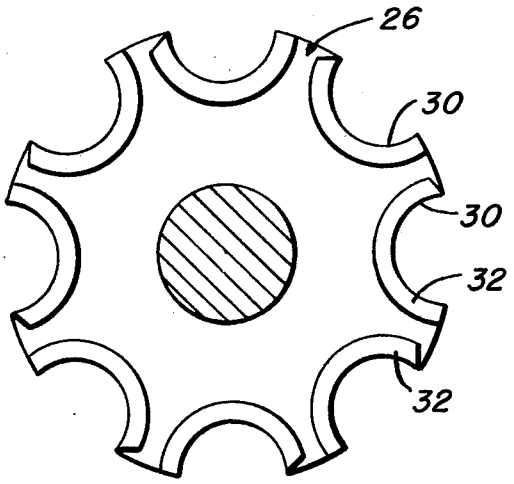
FIG. 2 is a side elevational view of the can carrying star wheel associated with the flanging chucks.
Figure 3:
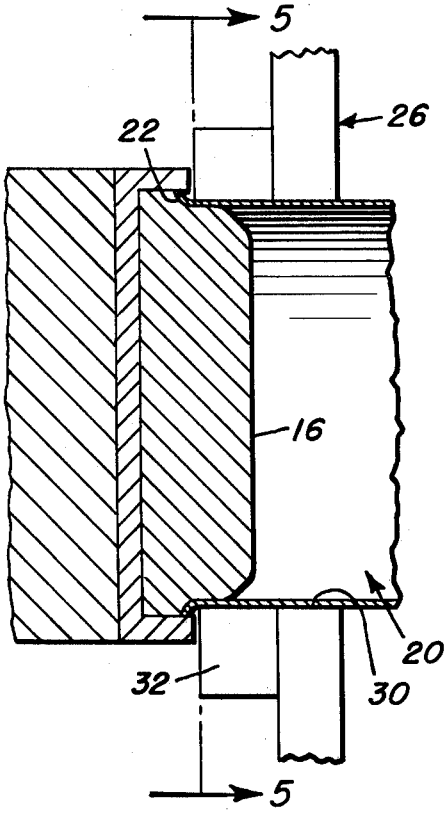
FIG. 3 is an enlarged cross-sectional detail through the flanged end of a star wheel carried can with the flanging chuck engaged therein and the stop positioned in can retaining relationship thereto.
Figure 4:
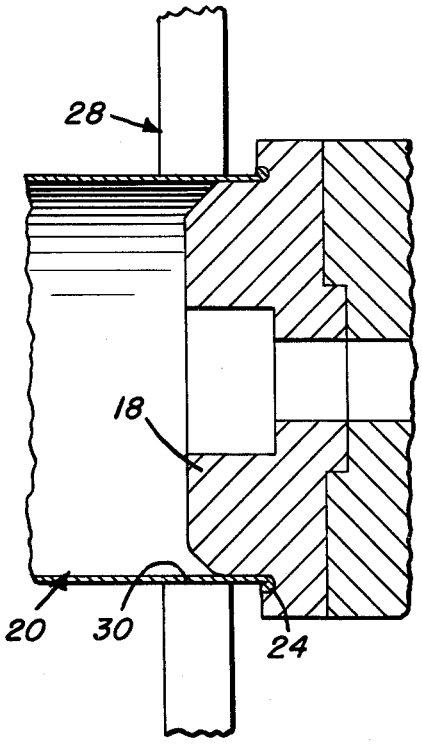
FIG. 4 is an enlarged cross-sectional detail of the opposed end of a can with the beading chuck engaged therein.
Figure 5:
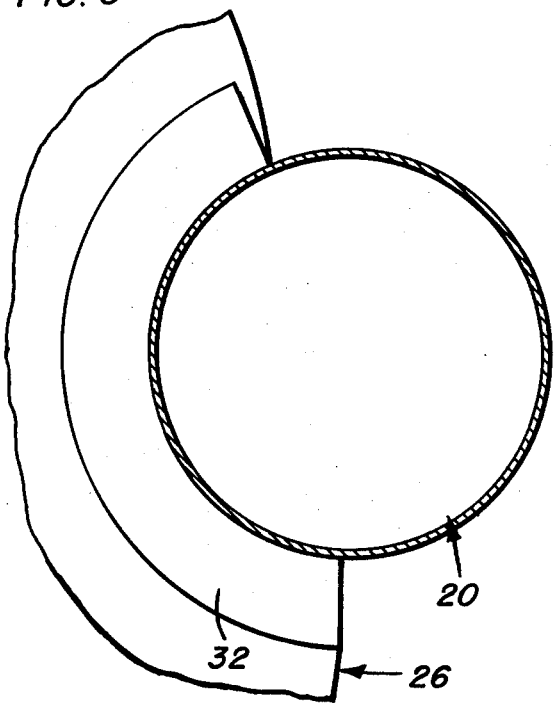
FIG. 5 is a face view of the can supporting star wheel taken substantially on a plane passing along line 5—5 in FIG. 3.
Figure 6:
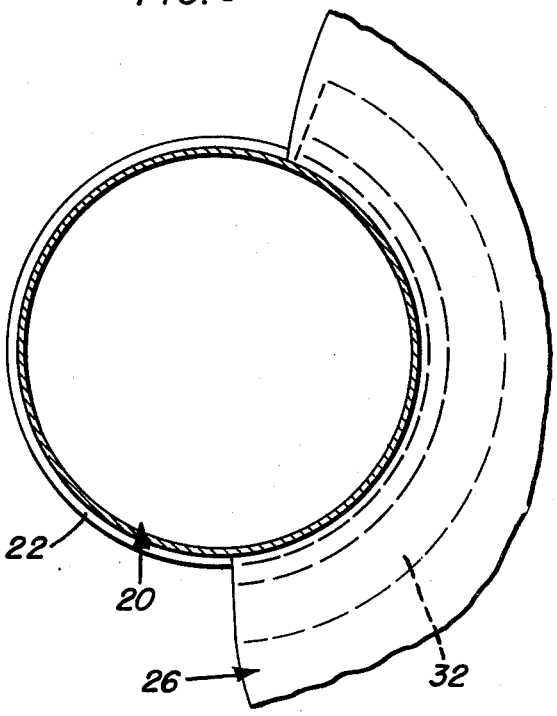
FIG. 6 is a detail view of the opposite face of the star wheel associated with the flanging chuck.

What is proposed herein is a unique means for providing for the positive retention of the relatively low friction engagement of the flange end 22 with the flanging chuck 16 while the relatively tightly engaged beading chuck 18 is withdrawn from the beaded end 24. This means consists of an arcuate stop, cuff or enlargement 32 affixed, as by rivets, machine screws, or the like, to the outer face of star wheel 26 adjacent each of the edge pockets 30 therein. As will be appreciated from the drawings, the stop 32, in each instance, has an edge which conforms to and forms an outwardly extending projection of the edge of the pocket 30. Each stop 32 is dimensioned to project from the outer surface of the star wheel 26 toward the flanging chuck a sufficient distance so as to overlie an inserted flanging chuck 16 with the outermost face of the stop 32 lying closely adjacent the formed flanged end 22 of the can 20. This relationship will be best appreciated from the cross-sectional detail of FIG. 3. In this manner, any tendency for the can 20 to move off of the flanging chuck 16 as the relatively tighter beading chuck 18 is withdrawn will be resisted by an engagement of the flanged end 22 with the stop 32. By the same token, the stop 32, rigidly affixed to the star wheel 26, will in no way interfere with the subsequent withdrawal of the flanging chuck 16 and the discharge of the can 20 from the star wheel carrier. It is to be appreciated that the stop 32 is mounted on and becomes a rigid portion of the star wheel 26 and requires no actuation or manipulation in the performance of its function as is required in the clamping means utilized in Wolfe, U.S. Pat. No. 3,797,429.

With reference to FIG. 7, the present invention also proposes a modification in the timing of the cam tracks 34, which respectively receive appropriate cam followers 36 affixed to the chucks 16 and 18 and operative in a conventional manner so as to effect the progressive extension and withdrawal of the chucks. This modification involves the orientation of the camming tracks or grooves 34 in a manner whereby the opposed pairs of chucks 16 and 18 will simultaneously engage within the opposed ends of the aligned can 20 and will sequentially withdraw therefrom with the relatively tighter beading chuck 18 withdrawing first, while the can 20 is retained by the stop 32, and with the relatively loose flanging chuck 16 subsequently withdrawing from the star wheel supported can. In this manner, there is no tendency for a lateral displacement of the cans and a smooth flow of the cans to, through and from the machine is achieved.

With reference to FIG. 9, it is to be appreciated that the stop 32 can be provided as an integral outwardly projecting enlargement extending from the outer surface of the star wheel 26 about each of the pockets 30 formed therein. This, assuming modification of an existing flanger, will require a replacement of the particular star wheel, rather than an attachment of the individual stops 32 to the star wheel at the side of the machine to be retained as a flanging operation.

The foregoing is considered illustrative of the principles of the invention. Since modifications and changes may occur to those skilled in the art, it is not desired to limit the invention to the exact construction and operation shown and described. Accordingly, all suitable modifications and equivalents may be resorted to, falling within the scope of the invention as claimed.

What is claimed is:

1. An apparatus for the formation of the opposed ends of a tubular can body including a pocketing rotary carrier for receiving and moving a can body along a predetermined path through said apparatus, opposed first and second die chuck means mounted for forming movement into engagement with the opposed ends of a can body as the can body moves along a portion of the path through the apparatus, and means for simultaneously moving said chuck means into engagement with said can ends; the improvements comprising means for sequentially moving said first chuck means out of engagement with the can body and then said second chuck means out of engagement with the can body, and stop means on a rigid with said carrier cooperating with the second chuck means, when engaged with the can body end, to engage and retain one end in engagement with the second chuck means as the first chuck means is moved out of engagement with the can body.

2. The apparatus of claim 1 wherein said stop means allows free retraction of the second chuck means from the corresponding can body end and from the stop means.

3. The apparatus of claim 2 wherein said rotary carrier comprises a pair of laterally spaced star wheels, each adjacent and having an outer face directed toward one of the opposed chuck means and each incorporating a series of peripheral can body receiving pockets, the pockets on the wheels being in laterally aligned pairs, each pair being adapted to receive and support a can body with the opposed ends thereof projecting outward of the outer faces of the star wheels respectively toward and for selective engagement by the first and second chuck means, said stop means comprising outwardly projecting enlargements defined about the pockets on the outer face of the wheel adjacent the second chuck means for orientation closely adjacent the end of the can body as it is formed by the second chuck means to effect, in cooperation with the second chuck means, a retention of this formed can body end on the second chuck means.

4. The apparatus of claim 3 wherein the outwardly projecting stop means is formed separately from and is secured to the star wheel adjacent the second chuck means.

5. The apparatus of claim 3 wherein the outwardly projecting retaining means is formed integrally with the star wheel adjacent the second chuck means.

6. The apparatus of claim 3 wherein said first chuck means comprises beading chucks, said second chuck means comprising flanging chucks.

* * * * *